US008925130B2

(12) United States Patent
Bedford

(10) Patent No.: US 8,925,130 B2
(45) Date of Patent: Jan. 6, 2015

(54) ACCESS APPARATUS FOR TRANSFERRING FROM VESSELS TO FIXED STRUCTURES

(75) Inventor: Stephen William Bedford, Northumberland (GB)

(73) Assignee: Osbit Power Limited, Northumberland (GB)

( * ) Notice: Subject to any disclaimer, the term of this patent is extended or adjusted under 35 U.S.C. 154(b) by 0 days.

(21) Appl. No.: 13/984,279

(22) PCT Filed: Feb. 8, 2012

(86) PCT No.: PCT/EP2012/052077
§ 371 (c)(1),
(2), (4) Date: Aug. 7, 2013

(87) PCT Pub. No.: WO2012/107459
PCT Pub. Date: Aug. 16, 2012

(65) Prior Publication Data

US 2013/0312204 A1 Nov. 28, 2013

(30) Foreign Application Priority Data

Feb. 11, 2011 (EP) ..... 11154223

(51) Int. Cl.

| | |
|---|---|
| ***E01D 15/00*** | (2006.01) |
| ***B63B 27/14*** | (2006.01) |
| ***B63B 21/00*** | (2006.01) |
| ***B63B 27/30*** | (2006.01) |

(52) U.S. Cl.
CPC ..... *B63B 27/143* (2013.01); *B63B 21/00* (2013.01); *E01D 15/00* (2013.01); *B63B 27/30* (2013.01)
USPC ..... 14/69.5; 14/71.1; 14/71.5; 14/71.7; 114/362

(58) Field of Classification Search
CPC ..... B63B 27/14; B63B 27/00; E01D 15/00
USPC ..... 404/31–40, 36.5–73.5; 114/362; 14/69.5–71.7
See application file for complete search history.

(56) References Cited

U.S. PATENT DOCUMENTS

| | | | | |
|---|---|---|---|---|
| 3,245,101 | A * | 4/1966 | Wilson | 14/18 |
| 3,426,719 | A | 2/1969 | Mizell | |
| 4,003,473 | A * | 1/1977 | Ryan | 14/71.7 |

(Continued)

FOREIGN PATENT DOCUMENTS

| | | | |
|---|---|---|---|
| GB | 2 428 656 | A | 2/2007 |
| WO | 00/15489 | A1 | 3/2000 |

(Continued)

OTHER PUBLICATIONS

International Search Report and Written Opinion from PCT Application No. PCT/EP2012/052077 dated Jul. 5, 2012.

*Primary Examiner* — Raymond W Addie
(74) *Attorney, Agent, or Firm* — Zilka-Kotab, PC

(57) ABSTRACT

An access apparatus for enabling transfer of personnel between a seaborne vessel and an offshore installation is disclosed. The apparatus comprises a body adapted to be mounted to a deck of a seaborne vessel, clamping members adapted to grip a buffer tube, mounted to a support of an offshore installation, therebetween, to limit vertical movement of the buffer tube relative to the clamping members, wherein the clamping members can pivot relative to the body about a respective single pivot axis extending in at least two mutually perpendicular directions.

20 Claims, 8 Drawing Sheets

(56) References Cited

U.S. PATENT DOCUMENTS

| | | | | |
|---|---|---|---|---|
| 4,133,283 | A * | 1/1979 | Ryan | 114/230.18 |
| 4,333,196 | A | 6/1982 | Bougaran | |
| 4,337,545 | A * | 7/1982 | Rose et al. | 14/71.1 |
| 4,421,051 | A | 12/1983 | Hammett | |
| 4,459,930 | A * | 7/1984 | Flory | 114/230.14 |
| 8,006,337 | B2 * | 8/2011 | Birmingham et al. | 14/71.1 |
| 8,566,992 | B1 * | 10/2013 | Stokes | 14/69.5 |
| 2003/0182741 | A1 * | 10/2003 | Prins | 14/71.1 |
| 2013/0255012 | A1 * | 10/2013 | Prins | 14/71.1 |

FOREIGN PATENT DOCUMENTS

| | | | |
|---|---|---|---|
| WO | 02/20343 | A1 | 3/2002 |
| WO | 2005/097591 | A1 | 10/2005 |
| WO | 2005/100145 | A1 | 10/2005 |
| WO | 2010/034429 | A2 | 4/2010 |
| WO | WO2012107459 | | 8/2012 |

* cited by examiner

ACCESS APPARATUS FOR TRANSFERRING FROM VESSELS TO FIXED STRUCTURES

This application claims priority to European Patent Appl. No. 11154223.9, filed Feb. 11, 2011; and to PCT Patent Appl. No. PCT/EP2012/052077, filed Feb. 8, 2012, which are herein incorporated by reference.

The present invention relates to access apparatus for transferring personnel and equipment between vessels and floating or fixed offshore installations, and relates particularly, but not exclusively, to access apparatus for transferring from vessels to supports for offshore wind turbines.

As a result of lack of space in areas where there is demand, the extent to which land based wind turbines can be built is limited. As a result, there is an increasing tendency to build offshore wind turbines.

Since the use of helicopters to gain access to offshore wind turbines is not preferred, it is generally necessary for personnel to gain access to the wind turbines by transferring from a sea vessel.

A support of an offshore wind turbine typically has an access ladder and buffer tubes provided on each side of the access ladder to prevent personnel on the ladder from being crushed between the ladder and a sea vessel.

It is known to provide access to a support of an offshore wind turbine by providing rubber buffers on the front of a boat such that the buffers of the boat push against the buffer tubes on each side of the ladder of the turbine support to create enough friction to prevent translation of the boat relative to the support in three planes. Personnel can then transfer across the gap between the front of the boat and the access ladder.

This arrangement suffers from the drawback that the frictional force between the boat and the tower is highly variable, and is dependent upon the difference between the thrust generated by the boat and the wave action on the hull of the boat, as well as any material such as slime and barnacles adhering to the buffer tubes. The available friction can also be reduced as a result of roll of the boat, and it is necessary for personnel to step between the ladder and the vessel which is moving relative to the support of the wind turbine, making transfer hazardous in rough seas.

One known attempt to overcome this problem consists of an access apparatus mounted to a vessel and having a platform for personnel which moves relative to the vessel to compensate for motion of the vessel relative to the turbine support, so that the platform is relatively stationary relative to the support of the wind turbine. However, this arrangement suffers from the drawback that the apparatus requires large power, is very expensive to acquire and run, and requires a large vessel to accommodate it.

GB 2428656 discloses an arrangement which consists of an inflatable gangway for connection between the wind turbine support and the vessel. However, this arrangement suffers from the drawback that modification to the access ladder of the turbine is necessary, the apparatus is slow to deploy if deflated, and is also too big for accommodation on small vessels if inflated.

One further known apparatus for coupling is vessel to a stationary object is disclosed in EP 1740448. However, this arrangement suffers from the drawback that significant movement of the deck of the vessel in a vertical direction relative to the stationary object occurs, as a result of which sophisticated and costly positioning apparatus is necessary to control the position of the vessel in heavy seas.

Preferred embodiments of the present invention seek to overcome one or more of the above disadvantages of the prior art.

According to the present invention there is provided an access apparatus for enabling transfer of personnel and/or equipment between seaborne vessels and/or between a seaborne vessel and an offshore installation, the apparatus comprising: a body adapted to be mounted to a deck of a seaborne vessel; and at least one engagement device including at least one set of clamping members adapted to grip a substantially vertical member, mounted to an offshore installation, therebetween, to limit vertical movement of said substantially vertical member relative to said clamping members, wherein at least one said set of clamping members is adapted to pivot relative to the body about a respective single pivot axis extending in at least two mutually perpendicular directions.

By providing engagement device(s) including at least one set of clamping members adapted to grip a substantially vertical member to limit vertical movement of the substantially vertical member relative to the clamping members, wherein at least one said set of clamping members is adapted to pivot relative to the body about a respective single pivot axis extending in at least two mutually perpendicular directions, this provides the advantage of limiting translational movement of the deck of the vessel relative to the offshore installation, enabling the safety of the apparatus to be improved at minimum cost. The advantage is also provided of enabling the vessel to which the apparatus is mounted to approach the offshore wind turbine at a wider range of angles than in the prior art, which in turn enables the apparatus to be safely used in rougher sea conditions.

It will be appreciated by persons skilled in the art that the respective single pivot axes could be real pivots or virtual pivots.

The apparatus may comprise at least one access device comprising at least one platform adapted to be fixed in position relative to at least one said set of clamping members for enabling personnel to transfer from said platform to the support of the offshore wind installation.

This provides the advantage of providing a static platform with respect to the offshore installation to further improve safety of use of the apparatus.

An end of said access device remote from at least one said platform may be adapted to move relative to said platform and/or the deck of the vessel.

This provides the advantage of enabling relative movement between the ends of the access device(s) to be absorbed to further improve the safety of use of the apparatus.

The position of at least one said platform may be adjustable relative to at least one said set of clamping members.

This provides the advantage of enabling the gap between the platform and the support of the offshore wind turbine to be controlled, further enhancing the safety of use of the apparatus.

At least one said platform may comprise a plurality of platform members adapted to move relative to each other to provide an adjustable platform surface.

This provides the advantage of further enabling the gap between the platform and the support of the offshore wind turbine to be further controlled, thereby further enhancing the safety of use of the apparatus.

A plurality of said platform members may be adapted to pivot relative to each other about at least one axis.

This provides the advantage of providing a compact construction of platform surface.

The apparatus may further comprise at least one biasing device for biasing at least one said platform towards a predetermined position relative to said engagement device(s).

At least one said set of clamping members may be adapted to be actuated by being urged into contact with the substantially vertical member.

This provides the advantage of improving the ease of use of the apparatus.

The apparatus may further comprise at least one force measuring device for measuring force between at least one said set of clamping members and the deck of the vessel.

This provides the advantage of enabling a determination to be made when personnel can no longer safely use the apparatus.

The apparatus may further comprise at least one indicator device for providing a signal to personnel in dependence on whether a predetermined load threshold is exceeded.

This provides the advantage of further improving the safety of the apparatus by enabling a warning to be provided when transfer from the platform to the turbine support is not safe.

Movement of at least one said set of clamping members relative to the deck of the vessel may be allowed when a predetermined load threshold is exceeded.

The apparatus may further comprise at least one damping device for damping relative movement between at least one said set of clamping members and the deck of the vessel.

The apparatus may further comprise at least one positioning device for enabling said engagement device(s) to be retracted relative to the deck of the vessel to enable the vessel to come into contact with a said substantially vertical member.

This provides the advantage of enabling relative movement of the vessel relative to the installation to be retarded on initial contact between the apparatus and the installation by means of buffers on the vessel, as opposed to by means of the apparatus. This in turn reduces the risk of damage to the apparatus.

The body may be demountable from a vessel.

The apparatus may further comprise at least one second biasing device for biasing at least one said set of clamping members to a respective second predetermined position relative to said body.

This provides the advantage of further enhancing the safety of the apparatus by reducing movement of the respective clamping members when the clamp is released.

Preferred embodiments of the invention will now be described, by way of example only and not in any limitative sense, with reference to the accompanying drawings, in which.

Figure 1:
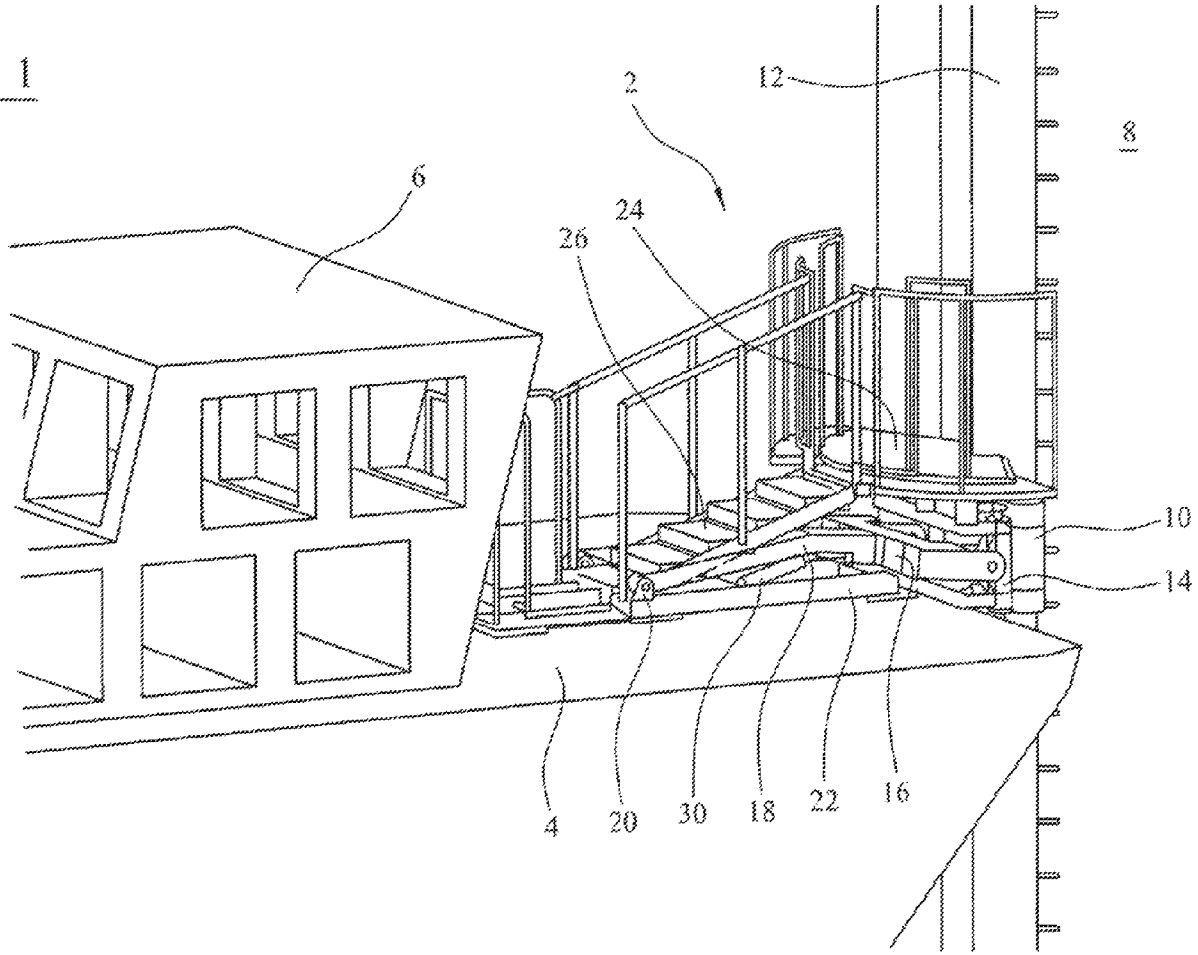
FIG. 1 is a perspective view of an access apparatus of a first embodiment of the present invention mounted to a deck of a seaborne vessel.
Figure 2:
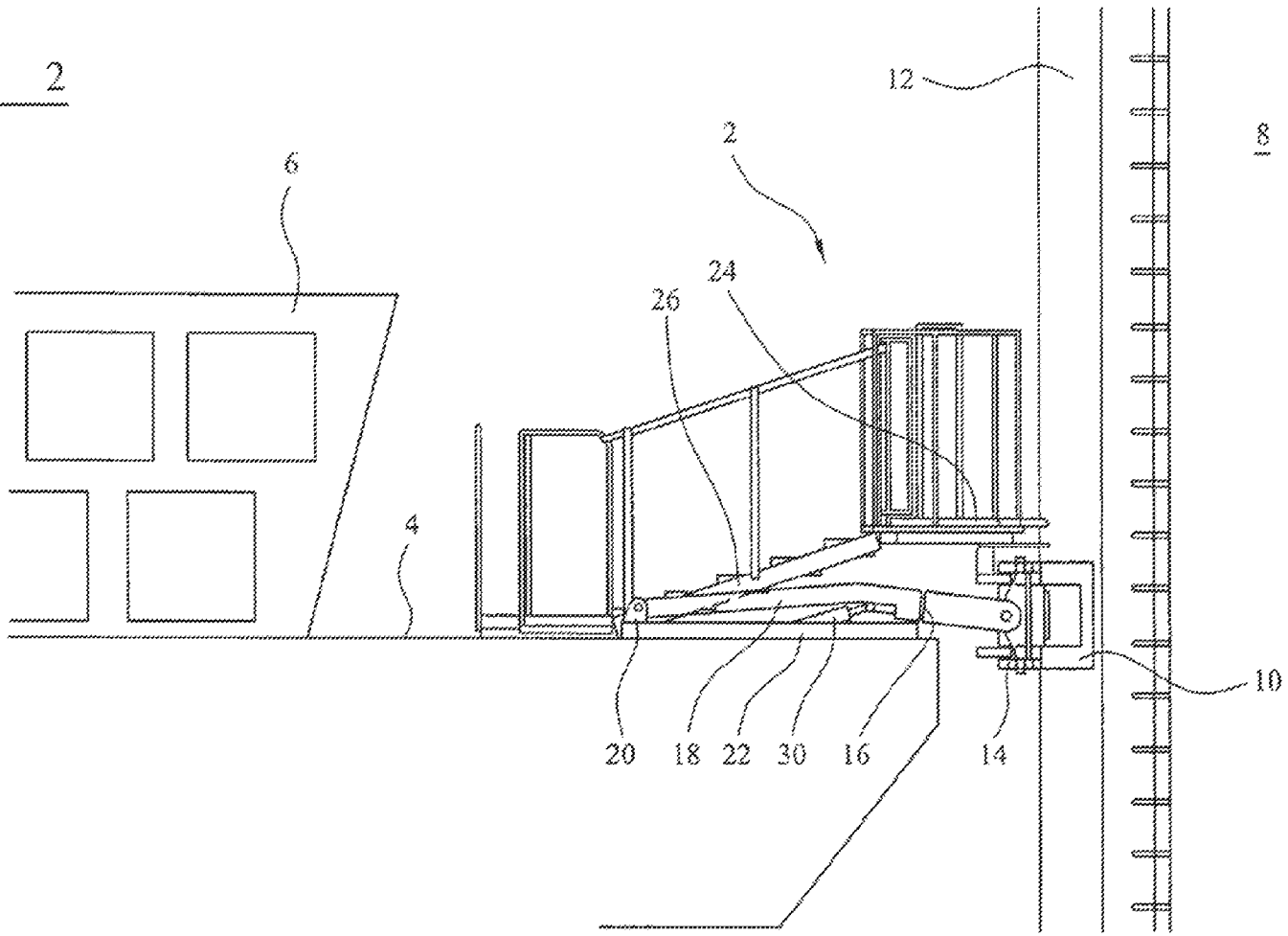
FIG. 2 is a side view of the access apparatus of FIG. 1.
Figure 3B:
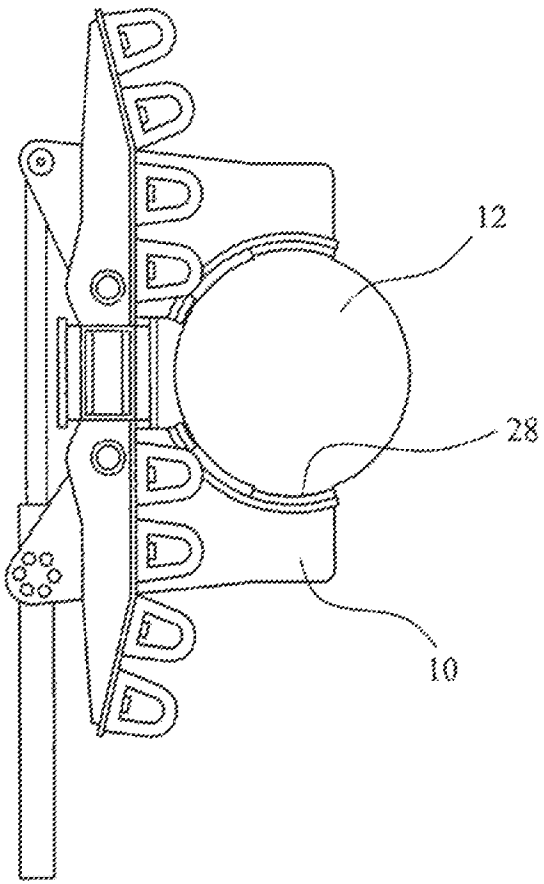
Figure 3A:
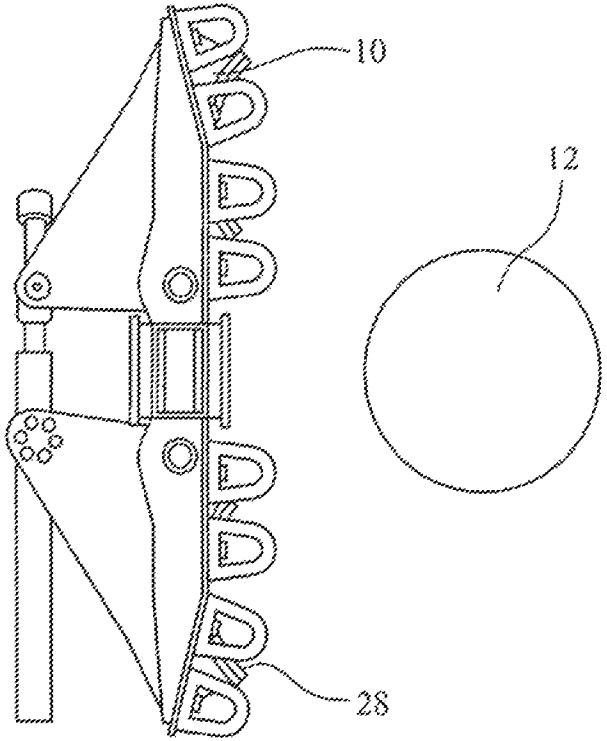
Figure 4:
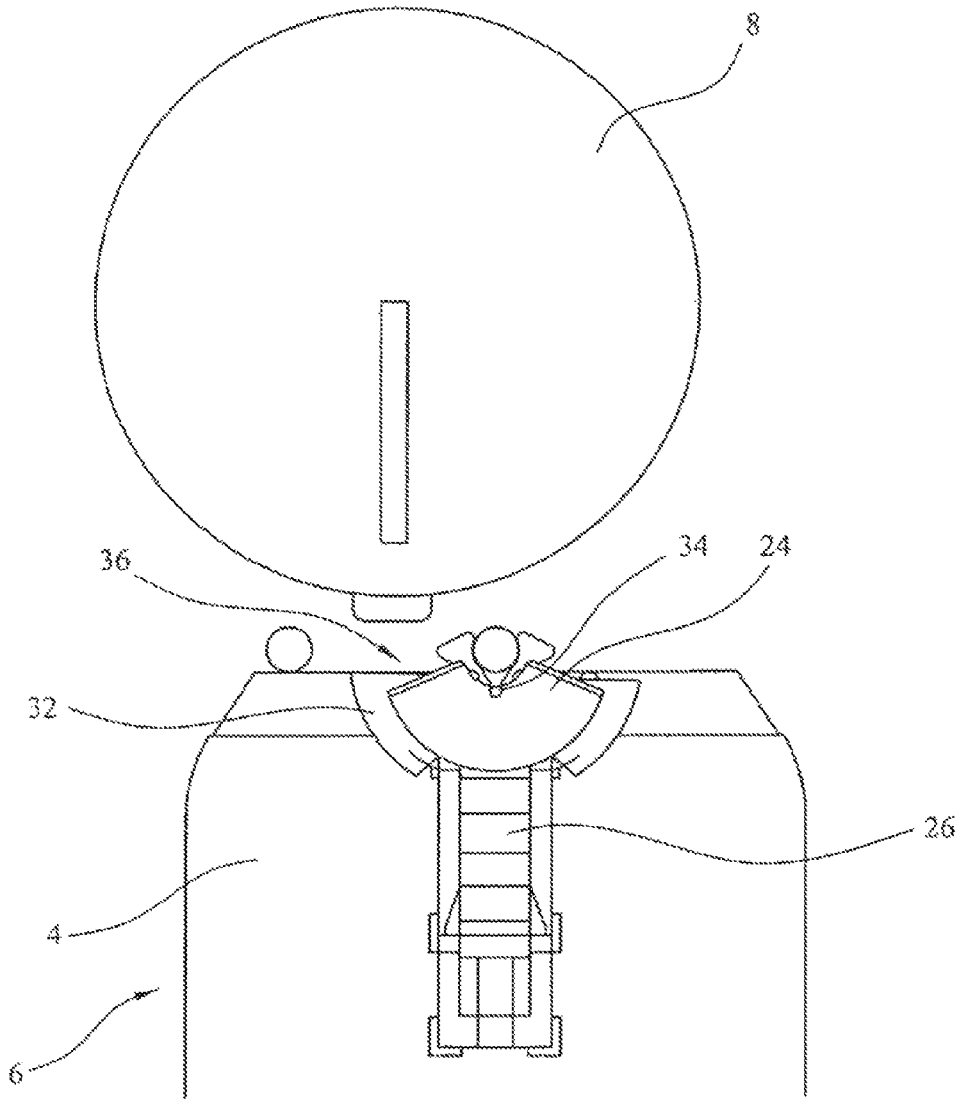
Figure 5:
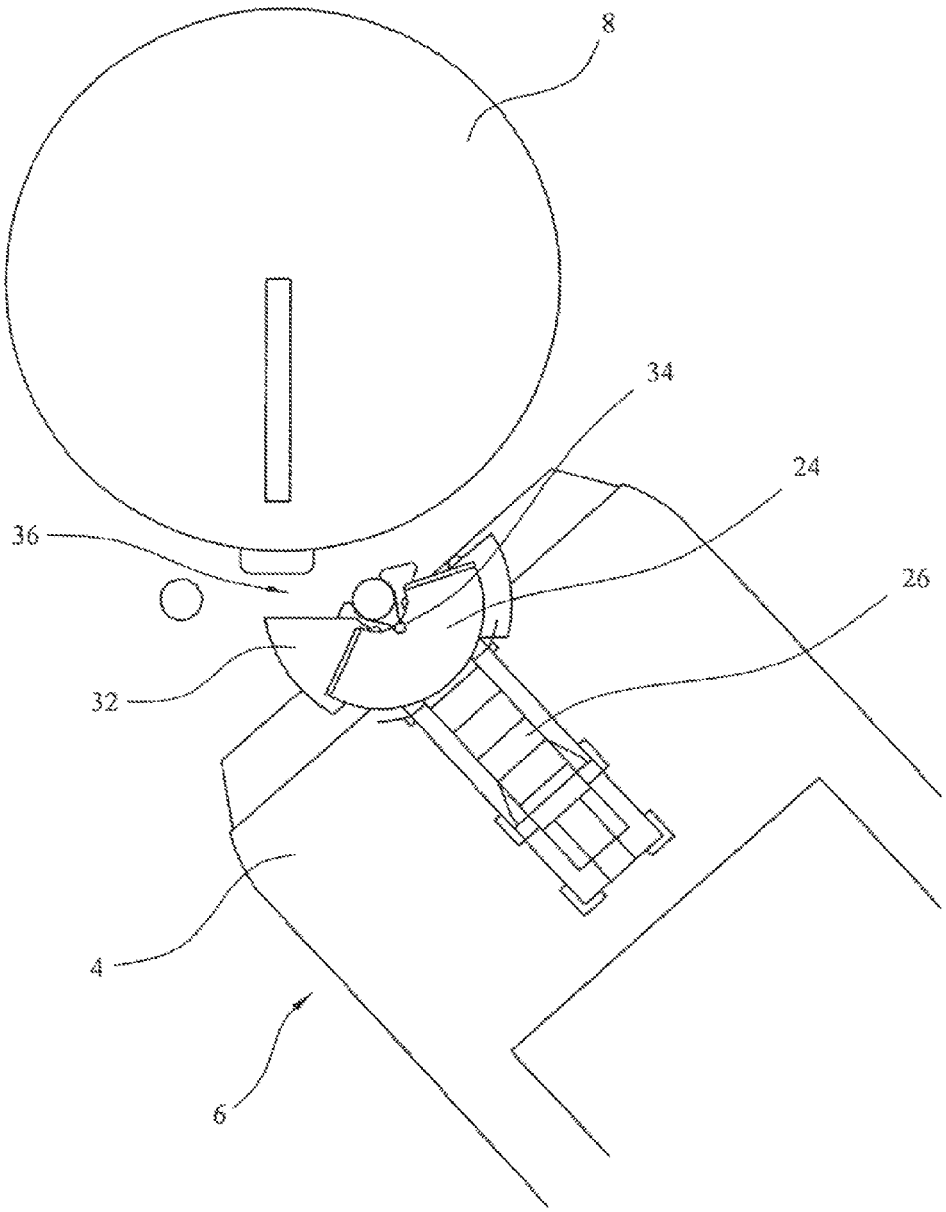
Figure 6:
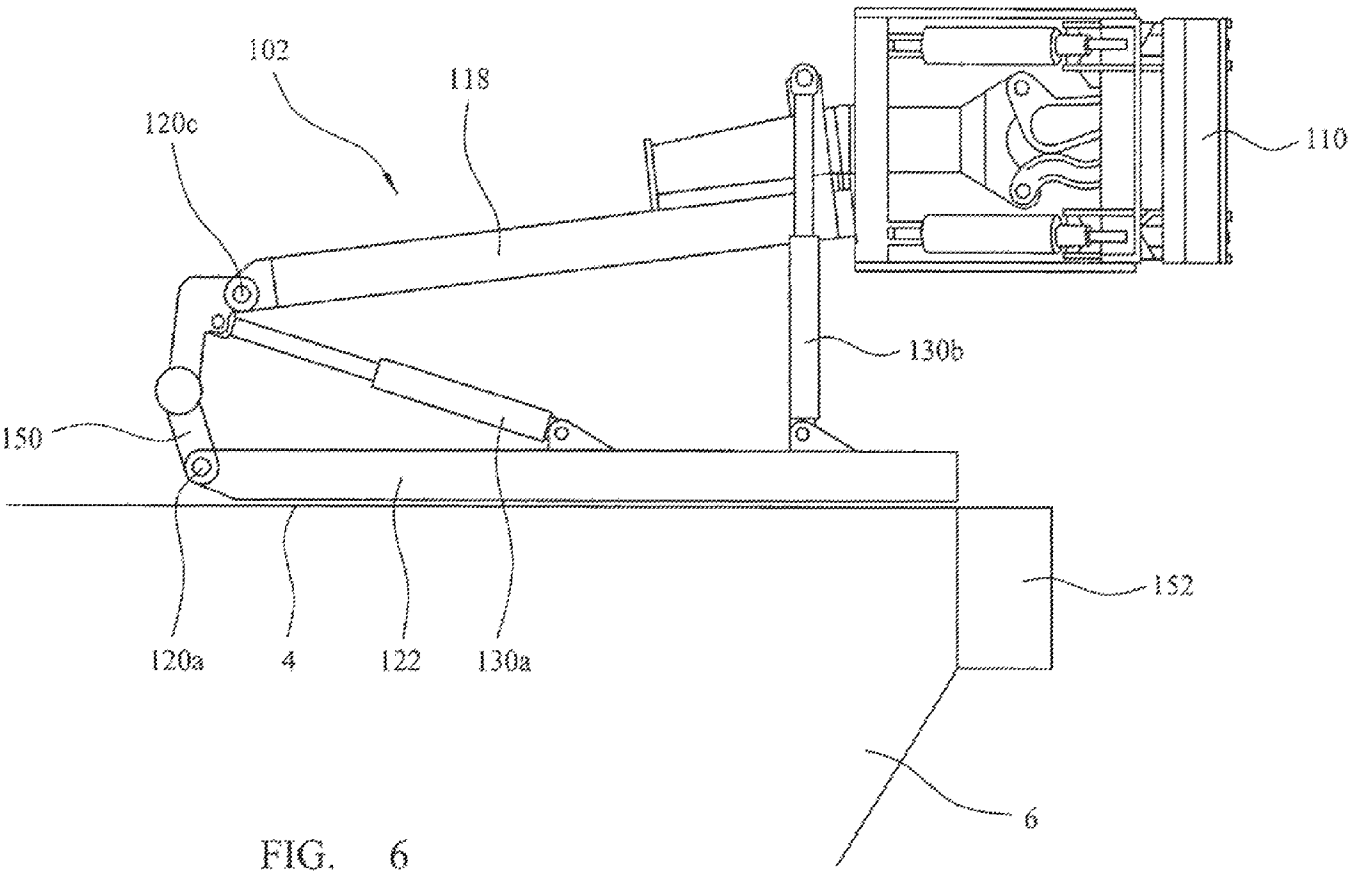
Figure 7:
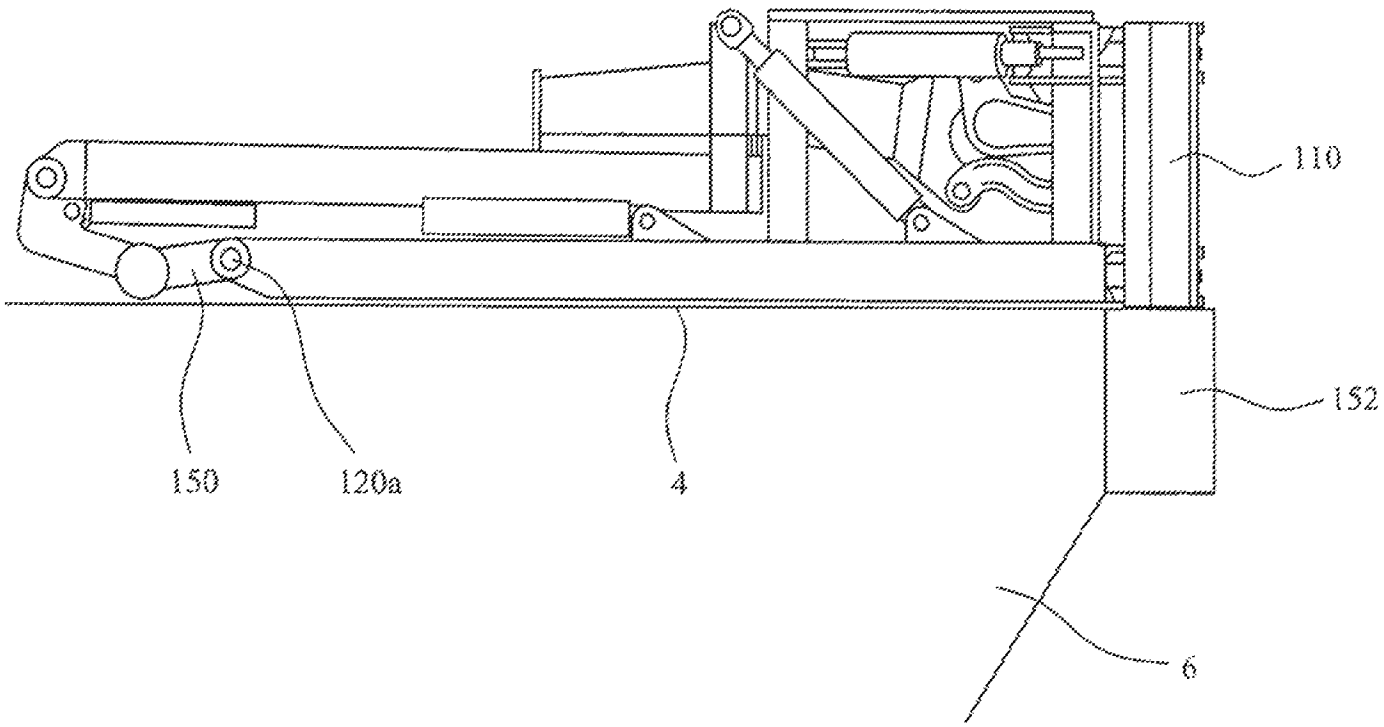
Figure 8:
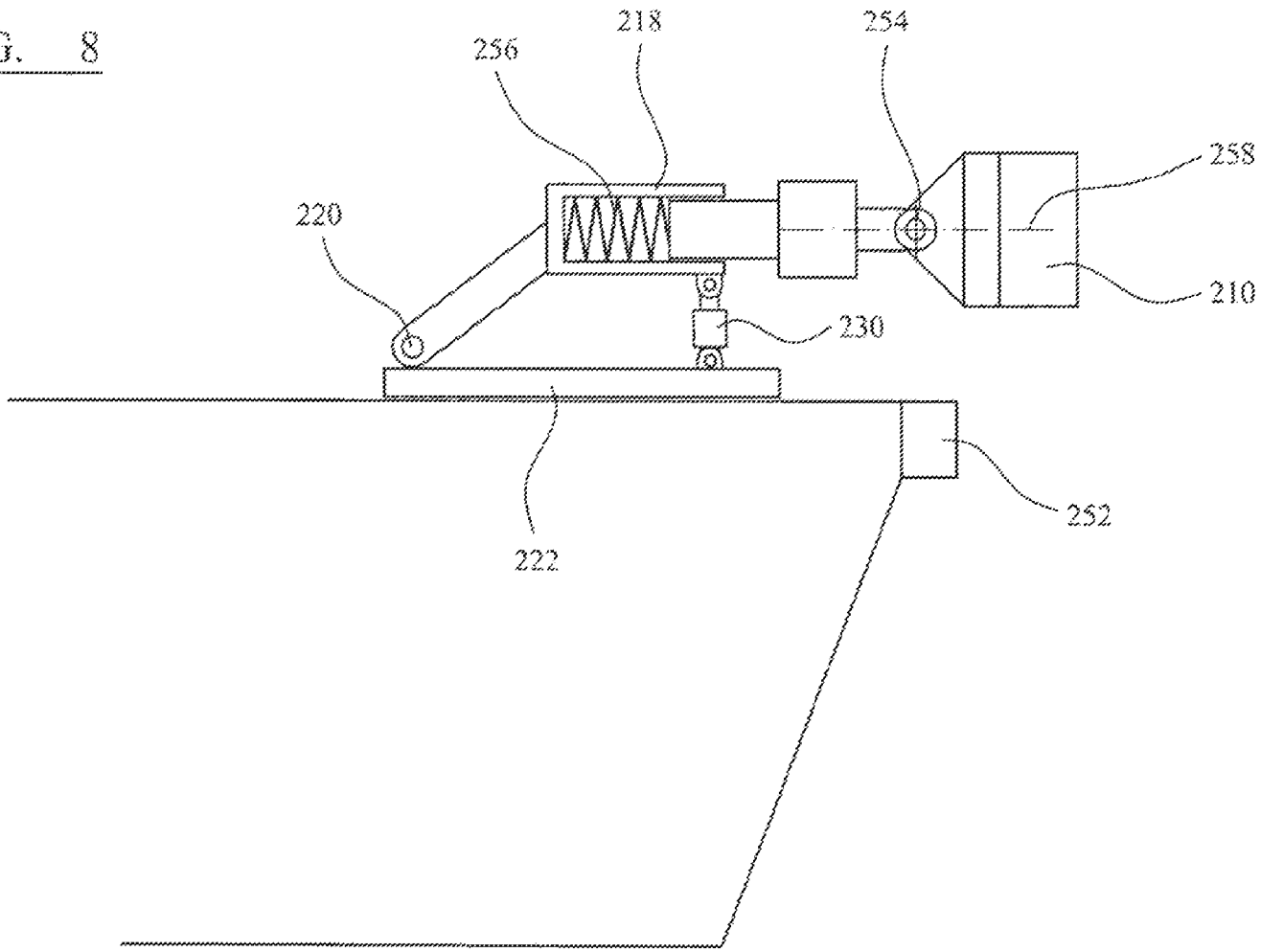

FIG. 3*a* is a plan cross sectional view of a set of clamping members of the access apparatus of FIGS. 1 and 2 in a release position;

FIG. 3*b* is a plan cross sectional view of a set of clamping members of the access apparatus of FIGS. 1 and 2 in a clamping position;

FIG. 4 is a plan view of the access apparatus of FIGS. 1 and 2 with the platform thereof in a first position;

FIG. 5 is a plan view corresponding to FIG. 4 with the platform in a second position thereof;

FIG. 6 is a side view of an access apparatus of a second embodiment of the present invention in a first position thereof;

FIG. 7 is a side view of the apparatus of FIG. 6 in a second position thereof; and FIG. 8 is a side view of an access apparatus of a third embodiment of the present invention.

Referring to FIGS. 1 and 2, an access apparatus 2 for enabling transfer of personnel from a deck 4 of a seaborne vessel 6 to a support 8 of an offshore wind turbine (not shown) comprises a set of clamping members 10 for clamping a vertical buffer tube 12 mounted to the support 8 of the offshore wind turbine therebetween, to restrict vertical movement of the clamping members 10 relative to the buffer tube 12. A housing 14 accommodates hydraulics (not shown) for operating the clamping members 10 and is connected via a gimbal arrangement 16 to a body 18 pivotably mounted via a pivot 20 to a frame 22 rigidly mounted to the deck 4 of the vessel 6. The gimbal arrangement 16 allows the housing 14 to pivot relative to the body 18 about a respective pivot axis extending along at least two mutually perpendicular directions. An access platform 24 is mounted on the housing 14 such that its position can be fixed relative to the set of clamping members 10, and a gangway 26 extends from the deck 4 of the vessel 6 to the access platform 24.

Referring in detail to FIGS. 3*a* and 3*b*, the clamping members 10 include a pair of clamping jaws 28 for applying a clamping force to the buffer tube 12, and are arranged so that the clamping jaws 28 are closed by being urged into contact with the buffer tube 12 therebetween to enable the clamping members 10 to be fixed relative to the buffer tube 12, or to only allow slight movement between the clamping members 10 and the buffer tube 12.

A hydraulic cylinder 30 is connected between the body 18 and the frame 22, and a force transducer (not shown) determines the load between the body 18 and the frame 22. A visual display (not shown) gives a visual indication when it is safe or unsafe for personnel to transfer between the platform 24 and the support 8, depending on the magnitude of the load between the body 18 and the frame 22. If a predetermined safety threshold is exceeded, limited pivotal movement of the body 18 relative to the frame 22 is allowed, and the hydraulic cylinder 30 damps the motion of the body 18 relative to the frame 22.

Referring to FIGS. 4 and 5, the platform 24 comprises a plurality of platform members 32 pivotable about an axis 34 to form a sector of a circle such that a gap 36 between the platform 24 and a support 8 of the wind turbine can be minimised. The gangway 26 extends from the platform 24 to the deck 4 of the vessel 6, and the end 38 of the gangway 26 remote from the platform 24 can move relative to the deck 4 of the vessel 6, for example by means of being supported by a roller.

The operation of the apparatus will now be described.

The vessel 6 approaches the buffer tube 12 at the most convenient permissible angle with regard to the direction of wind, current and wave motion such that the buffer tube 12 is located between the clamping jaws 28. At the highest point of the wave motion, i.e. when the vessel 6 is at its greatest height relative to the buffer tube 12, the vessel 6 urges the clamping jaws 28 into engagement with the buffer tube 12, as a result of which the clamping jaws 28 are hydraulically actuated to apply a clamping force to the buffer tube 12. The vessel 6 is then connected to the buffer tube 12 in such a way that the clamping jaws 28 can move relative to the body 18 about at least two mutually perpendicular axes of rotation through the gimbal arrangement 16.

Depending upon the angle of the longitudinal axis of the vessel 6 relative to the buffer tube 12, the platform members 32 are pivoted about their axis of rotation 34 so as to minimise any gap 36 between the platform 24 and an access ladder mounted to the support 8 of the offshore wind turbine. The visual display then indicates whether the force between the body 18 and the frame 22 is such that the clamping force of the clamping jaws 28 is likely to be exceeded, and if the force is below a safety threshold, the visual indicator indicates that it is safe for personnel to transfer along the gangway 26 from the deck 4 of the vessel 6 to the platform 24 and to cross from the platform 24 to the access ladder.

If the force between the body 18 and the frame 22 exceeds a predetermined safety threshold such that a clamping force of the clamping jaws 28 is likely to be exceeded, the visual indicator indicates that it is no longer safe for personnel to transfer along the gangway 26. The clamping jaws 28 can then be opened to release the buffer tube 12 and the vessel 6 moved away from the support.

Referring to FIG. 6, in which parts common to the embodiment of FIGS. 1 to 5 are denoted by like reference numerals but increased by 100, an access apparatus 102 of a second embodiment of the present invention has a body 118 connected to a frame 122 via two pivots 120*a*, 120*c* and first hydraulic cylinder 130*a* and second hydraulic cylinder 130*b*. Clamping members 110 are moveable from a deployed position as shown in FIG. 6 to a stowed position as shown in FIG. 7 by pivoting link 150 about pivot 120*a* until link 150 comes into contact with deck 4 of the vessel 6. In the position shown in FIG. 6, the clamping members 110 are arranged forwardly of a shock absorbing fender 152 arranged at the front of the vessel 6, whereas in the position shown in FIG. 7, the fender 152 extends forwardly further than the clamping members 110.

As the clamping members 110 are brought into engagement with the buffer tube 12, the deceleration forces initially encountered by the apparatus 102 are significant. The clamping members 110 are allowed to move under the action of hydraulic cylinders 130*a*, 130*b* from the position shown in FIG. 6 to that shown in FIG. 7, to enable the fender 152 at the front of the vessel 6 to come into contact with the buffer tube 12. This enables the vessel 6 to be steadied, while avoiding the necessity of reacting the considerable deceleration forces through the apparatus 102. After the vessel 6 has been steadied by means of contact between the fender 152 and the buffer tube 12, the hydraulic cylinders 130*a*, 130*b* are then actuated to move the clamping members 110 back into contact with the buffer tube 12 to then clamp the buffer tube 12 between the clamping members 110.

Referring to FIG. 8, in which parts common to the embodiment of FIGS. 6 and 7 are denoted by like reference numerals but increased by 100, clamping members 210 are connected via pivot 254 to telescopic body 218 having compression spring 256. The body 218 is connected to frame 222 via pivot 220 and hydraulic cylinder 230. As the clamping members 210 are brought into contact with the buffer tube 12, the clamping members 210 can move to the left as shown in FIG. 8 relative to the body 218 against the action of compression spring 256 steadying the vessel until fender 252 comes into contact with the buffer tube 12 to further steady the vessel. With the vessel steady, the spring 256 moves the clamping members 210 to the right as shown in FIG. 8 to enable the buffer tube 12 to be clamped between the clamping members 210. The clamping members 210 are biased about pivot 254 by means of suitable springs (not shown) to align central axis 258 of clamping members 210 with the longitudinal axis of body 218 to minimise movement of the clamping members 210 when not clamped to the buffer tube 12.

It will be appreciated by persons skilled in the art that the above embodiment has been described by way of example only, and not in any limitative sense, and that various alterations and modifications are possible without departure from the scope of the invention as defined by the appended claims.

The invention claimed is:

1. An access apparatus for enabling transfer of personnel and/or equipment between seaborne vessels and/or between a seaborne vessel and an offshore installation, the apparatus comprising:

a body adapted to be mounted to a deck of a seaborne vessel; and an engagement device including a set of clamping members adapted to grip a substantially vertical member of a seaborne vessel or offshore installation, to limit vertical movement of said substantially vertical member relative to said set of clamping members, wherein a gimbal arrangement is disposed between the body and said set of clamping members, such that said set of clamping members are pivotable relative to the body in at least two mutually perpendicular directions.

2. An apparatus according to claim 1, further comprising an access device comprising at least one platform adapted to be fixed in position relative to said set of clamping members for enabling personnel to transfer from said platform to the offshore installation.

3. An apparatus according to claim 2, wherein an end of said access device remote from at least one said platform is adapted to move relative to said platform and/or the deck of the vessel.

4. An apparatus according to claim 3, wherein the position of at least one said platform is adjustable relative to at least one said set of clamping members.

5. An apparatus according to claim 3, wherein at least one said platform comprises a plurality of platform members adapted to move relative to each other to provide an adjustable platform surface.

6. An apparatus according to claim 5, wherein a plurality of said platform members are adapted to pivot relative to each other about at least one axis.

7. An apparatus according to claim 3, further comprising at least one first biasing device for biasing at least one said platform towards a respective first predetermined position relative to at least one said engagement device.

8. An apparatus according to claim 1, wherein said set of clamping members is adapted to be actuated by being urged into contact with a said substantially vertical member.

9. An apparatus according to claim 1, further comprising force measuring means for measuring force between said set of clamping members and the deck of the vessel.

10. An apparatus according to claim 9, further comprising an indicator means for providing a signal to personnel in dependence on whether a predetermined load threshold is exceeded.

11. An apparatus according to claim 9, wherein movement of said set of clamping members relative to the deck of the vessel is allowed when a predetermined load threshold is exceeded.

12. An apparatus according to claim 11, further comprising damping means for damping relative movement between said set of clamping members and the deck of the vessel.

13. An apparatus according to claim 1, further comprising positioning means for enabling at least one said engagement device to be retracted relative to the deck of the vessel to enable the vessel to come into contact with a said substantially vertical member.

14. An apparatus according to claim 1 wherein said body is demountable from a vessel.

15. An apparatus according to claim 13, further comprising a second positioning means for positioning said set of clamping members to a respective second predetermined position relative to said body.

16. An apparatus according to claim 1 wherein the body is pivotable about only a single pivot axis relative to the deck of the seaborne vessel.

17. An apparatus according to claim 16 wherein the body is pivotably mounted via a pivot to a frame rigidly mounted to the deck.

18. An apparatus according to claim 1 wherein the said set of clamping members is adapted to pivot relative to the body about three pivot axes extending in three mutually perpendicular directions.

19. An apparatus according to claim 1 wherein the at least one said set of clamping members is adapted to pivot relative to the deck of the seaborn vessel about a respective single pivot axis extending in three mutually perpendicular directions, wherein the at least one said set of clamping members is adapted to pivot relative to the deck of the seaborn vessel in two of the directions only about the respective single pivot axis.

20. An apparatus according to claim 18 wherein the at least one said set of clamping members is adapted to pivot relative to the deck of the seaborn vessel about two or more parallel single pivot axes extending in a horizontal direction.

* * * * *